United States Patent [19]

L'Hermite et al.

[11] 4,211,584

[45] Jul. 8, 1980

[54] METHODS OF HEAT-TREATING STEEL

[75] Inventors: Mathurin L'Hermite; François Pierrard, both of Versailles, France

[73] Assignee: L'Air Liquide, Societe Anomyme pour L'Etude et l'Explotion des Procedes, Paris, France

[21] Appl. No.: 785,092

[22] Filed: Apr. 6, 1977

Related U.S. Application Data

[63] Continuation of Ser. No. 605,286, Aug. 18, 1975, abandoned.

[30] Foreign Application Priority Data

Sep. 20, 1974 [FR] France ..... 74 31744

[51] Int. Cl.[2] ..... C21D 1/48

[52] U.S. Cl. ..... 148/16.7; 148/16.5

[58] Field of Search ..... 148/12, 14, 16, 20.3, 148/16.8, 16.7

[56] References Cited

U.S. PATENT DOCUMENTS

| | | | |
|---|---|---|---|
| 2,287,467 | 6/1942 | Carpenter et al. | 148/16 |
| 2,815,305 | 12/1957 | Ipsen | 148/16 |
| 3,281,286 | 10/1966 | Shimizu et al. | 148/12.1 |
| 3,413,161 | 11/1968 | Goehring | 148/16.5 |

OTHER PUBLICATIONS

Lyman et al. (Ed.): *Metals Handbook,* II, Ohio (ASM), 1964, pp. 83–86; (Heat Treating, etc.).

Lyman et al. (Ed.): *Metals Handbook,* II, Ohio (ASM), 1964, pp. 70–75.

Metals Handbook, 8th Ed., vol. 2, pp. 14–15, 1964.

*Primary Examiner*—L. Dewayne Rutledge

*Assistant Examiner*—John P. Sheehan

*Attorney, Agent, or Firm*—Browdy and Neimark

[57] ABSTRACT

This invention relates to a method of heat-treating steel in a furnace in the presence of a controlled atmosphere.

The $H_2O$ content of the furnace is determined, the atmosphere is formed by adding to a carrier gas a quantity of a hydrocarbon having the general formula $C_xH_y$ which is necessary and sufficient to reduce the water in the furnace in accordance with the following reaction:

$$C_xH_y + xH_2O \rightarrow xCO + (x+y/2)H_2,$$

and the steel is raised to a temperature between 650° and 900° C.

The method is applicable to the annealing, heating before quenching, and tempering of steel.

6 Claims, No Drawings

METHODS OF HEAT-TREATING STEEL

This is a continuation, of application Ser. No. 605,286, filed Aug. 18, 1975, now abandoned

BACKGROUND OF THE INVENTION

The present invention relates in general terms to methods of heat-treating steel, such an annealing, heating prior to quenching and tempering, in which it is important that the chemical composition of the surface of the metal should be altered and therefore that oxidation, de-carburization and carburization of its surface should be prevented. Such treatments generally take place in furnaces in the presence of a predetermined controlled atmosphere.

For treatments of this type, there have already been used atmospheres formed by gases which do not react to any appreciable degree with steel at the temperatures employed, which gases may be nitrogen or a mixture of nitrogen and hydrogen. In practice however, when nitrogen is used alone, it is difficult to avoid surface oxidation, while a mixture of nitrogen and hydrogen, although able to prevent such oxidation, does not generally allow surface de-carburization to be avoided. In other words, these known methods do not allow the desired results to be achieved.

Also known are methods of heat-treating steel of the aforementioned type in which the atmosphere used is formed by mixing a carrier gas (nitrogen alone or a mixture of nitrogen and hydrogen) with a hydrocarbon having the general formula $C_xH_y$. However, the type of atmosphere in which the carrier gas is formed by nitrogen alone usually leads to the formation of soot deposits at temperatures equal to or lower than 850° C., while atmospheres in which the carrier gas is formed by a mixture of nitrogen and hydrogen give very erratic results because of the difficulty of accurately regulating the carburizing activity or carbon potential of the said atmosphere. Any error in the regulation of this carburizing activity results in the metal being treated either carburized or de-carburized to an excessive degree.

It is accordingly an object of the present invention to remedy or minimize the above-mentioned shortcomings of known methods.

Studies made of the de-carburizing activity of hydrogen have shown that this element, when dry, has virtually no de-carburizing activity below 900° C. Wet hydrogen on the other hand, is a powerful de-carburizer. In other words, its de-carburizing activity is chiefly due to the presence of water.

When an atmosphere containing hydrogen is used in an industrial furnace, it is very difficult to prevent water from forming, as a result of the presence of oxygen and oxides in the furnace.

The result is that, when a mixture of nitrogen and hydrogen, even a very dry one, is fed into an industrial furnace, a mixture of nitrogen, hydrogen and water always forms in the furnace.

It is also known that hydrocarbons have the characteristic of reducing water in accordance with a reaction of the following type:

$$CH_4+H_2O \rightarrow CO+3H_2$$

that is to say by generating carbon monoxide and hydrogen.

These reactions take place at temperatures of the order of 650° to 900° C.

The problem which the invention is intended to solve, with, as mentioned above, the object of remedying or minimizing the shortcomings of known methods, is thus on the one hand to prevent the formation of water in the furnace, which inevitably results in decarburization, and on the other hand to avoid an excess of hydrocarbon which would inevitably lead to excessive surface carburization.

SUMMARY OF THE INVENTION

The treatment method according to the invention, which is applicable to the annealing, heating prior to quenching, and tempering of steel in a furnace in the presence of a continuously flowing atmosphere which is obtained by mixing a carrier gas containing nitrogen and possibly hydrogen with an active gas formed by a hydrocarbon, allows the aforementioned object to be achieved by virtue of the fact that it consists in determining the $H_2O$ content of the furnace, in producing the aforesaid atmosphere by mixing with the carrier gas a quantity of the said hydrocarbon which is necessary and sufficient to reduce the water contained in the furnace in accordance with a reaction of the following type:

$$C_xH_y+xH_2O \rightarrow xCO+(x+y/2)\ H_2$$

and in bringing this atmosphere into contact with the steel, which latter has been brought to a temperature between 650° and 900° C.

The result of regulating the hydrocarbon content of the treatment atmosphere so that the aforementioned reaction takes place is that the water is removed as and when it is formed, or at least the water content is reduced to a level sufficiently low to prevent de-carburization without leaving hydrocarbon molecules capable of combining with the steel and thus carburizing it.

It should be pointed out that the hydrocarbon contents of the atmospheres used to put the invention into effect are very much lower than the hydrocarbon contents of atmospheres used to carburize steel.

In accordance with another feature of the invention, the hydrocarbons used are $C_3H_8$, $C_2H_4$, $C_2H_6$, $C_2H_2$, $C_4H_{10}$ or natural gas, these hydrocarbons being used alone or in any desired mixture thereof.

The aforementioned hydrocarbons are the ones which allow the best efficiencies to be achieved in the water-reducing reaction whether used alone or in mixtures.

In accordance with another feature of the invention, the $H_2O$ content of the furnace is determined by measuring the dew point at the outlet from the said furnace.

Since the only thing which is monitored is the dew point, the result is that the method according to the invention is particularly easy to put into practice.

The invention also relates to the new industrial products constituted by the steels obtained by the aforementioned method.

Various experiments have been performed to produce a sufficiently dry $N_2+H_2$ atmosphere by adding to this atmosphere a small percentage of a hydrocarbon which is capable of reducing water in accordance with a reaction of the following type:

$$C_xH_y+xH_2O \rightarrow xCO+(x+y/2)\ H_2$$

Thus, the following reactions are obtained in the cases of, for example, methane, propane and ethylene respectively:

$$CH_4+H_2O \rightarrow CO+3H_2$$

$$C_3H_7+3H_2O \rightarrow 3CO+7H_2$$

$$C_2H_4+2H_2O \rightarrow 2CO+4H_2$$

Study of these reactions shows that, beside the water content measured in the furnace, the hydrocarbon content of the atmosphere according to the invention depends chiefly on the nature of the hydrocarbon selected and on the efficiency of the water-reducing reaction.

The hydrocarbon content of the treatment atmosphere is also a function of the permitted quantity of water in the furnace below which there is no appreciable decarburization.

Experiments have also shown that, depending on the dew-point measured in the furnace, the hydrocarbon content of the treatment atmosphere may vary from 0 to 4% where natural gas is used and from 0 to 2% in the case of the other hydrocarbons.

Using atmospheres having a hydrocarbon content within the limits quoted, it has been possible to obtain steel parts which suffer no surface decarburization and whose surface appearance remains good.

The best results were obtained with atmospheres whose carrier gas was formed by a mixture of hydrogen and nitrogen with a maximum hydrogen content of 10%, to which mixture was added a suitable quantity of one of the hydrocarbons, the steel being raised to a temperature between 650° and 900° C.

Atmospheres with a carrier gas formed solely by nitrogen were also used under the same temperature conditions and with these it was possible to prevent surface decarburization of the steel being treated. However, with these atmospheres there is a danger in certain cases of giving the steel a slight coloration or of forming heavier soot deposits than with $N_2+H_2$ atmospheres, which generally restricts the use of such atmospheres to treatment where an impeccable surface appearance is not required.

The control of the treatment, that is to say the amount of hydrocarbon to be introduced into the atmosphere fed into the furnace may be performed continuously, which implies that the dew point is measured continuously, or intermittently, in which case the dew point is only measured at intervals.

DETAILED DESCRIPTION OF PREFERRED EMBODIMENTS

EXAMPLE 1.

Annealing a steel to French standard XC120 (Association Francaise de Normalisation—AFNOR—Standard), which was held at 800° C. for three hours.

The composition of the treatment atmosphere was as follows:

| | | |
|---|---|---|
| $N_2$ | : | 89.9% |
| $H_2$ | : | 10% |
| $C_3H_8$ | : | 0.1% |

Dew-point at the outlet of the furnace: −28° C.

After treatment the steel showed no surface de-carburization and its surface was virtually white in appearance, that is to say it was free of oxidation and soot deposits.

A comparative treatment carried out on the same steel, under the same temperature conditions but with an atmosphere formed from 90% $N_2$ and 10% $H_2$, i.e. with no hydrocarbon added, gave parts whose surface looked the same, (i.e. white) but which showed surface de-carburization approximately 100 microns deep.

EXAMPLE 2.

Heating prior to quenching of a steel of standard 35CD4 which was held at 880° C. for two hours.

The composition of the treatment atmosphere was as follows:

| | | |
|---|---|---|
| $N_2$ | : | 99.6 |
| $C_2H_4$ | : | 0.4% |

The dew-point at the outlet of the furnace was −24° C.

The parts obtained after treatment were free of decarburization and their surface was grey-white in appearance.

The same steel, when treated by way of comparison under the same temperature conditions but with an atmosphere formed solely by nitrogen and free of ethylene, produced parts which, after treatment, showed surface de-carburization 300 microns deep and whose surface looked black due to oxidation.

EXAMPLE 3.

Annealing a steel to XC38 standard which was held at 710° C. for ten hours.

The composition of the treatment atmosphere was as follows:

| | | |
|---|---|---|
| $N_2$ | : | 94.75% |
| $H_2$ | : | 5.0% |
| $C_3H_8$ | : | 0.25% |

The dew-point at the outlet of the furnace was 0° C.

The parts obtained after treatment were free of decarburization and their surface was white in appearance.

The same steel, when treated at the same temperature under the same conditions, but with an atmosphere of nitrogen plus 5% hydrogen with no propane had the same white surface but showed surface decarburization 100 microns deep.

The treatment method according to the invention may be applied to annealing steel with decarburization at temperature between 650° and 900° C., to heating carbon-rich steel before quenching to between 750° and 900° C., and to tempering of certain alloyed steels at temperatures up to 700° C.

We claim:

1. In the method of heat-treating steel, without altering the composition of the surface of the steel, comprising heating the steel in a furnace while causing substantially non-reacting carrier gas consisting of nitrogen and 0–10% hydrogen to continuously flow therethrough, the improvement whereby the decarburizing activity of wet hydrogen is avoided, comprising:

heating the steel in the furnace to within a range between 650° and 900° C.;

determining the water content of the flowing atmosphere by measuring the dew-point at the outlet of the furnace; and varying the composition of the atmosphere by mixing with the carrier gas an amount of hydrocarbon which is sufficient to reduce the water content of the atmosphere in the furnace, and therefore the dew-point of said atmosphere, to a sufficiently low level to avoid decarburization of the steel, but which amount of hydrocarbon is insufficient to cause carburization of the steel.

2. A method according to claim 1, wherein the hydrocarbons used are selected from the group consisting of $C_3H_8$, $C_2H_4$, $C_2H_6$, $C_2H_2$, $C_4H_{10}$, and natural gas.

3. A method according to claim 1, when applied to annealing steel, wherein said dew-point at the outlet from said furnace is −28° C., and the treatment atmosphere has the following composition:

| | | |
|---|---|---|
| $N_2$ | : | 89.9% |
| $H_2$ | : | 10.0% |
| $C_3H_8$ | : | 0.1% |

the steel being raised to a temperature of 800° C. and the treatment taking place over three hours.

4. A method according to claim 1, when applied to heating a steel before quenching, wherein said dew-point at the outlet from said furnace is −24° C., and the treatment atmosphere has the following composition:

| | | |
|---|---|---|
| $N_2$ | : | 99.6 |
| $C_2H_4$ | : | 0.4% |

the steel being raised to a temperature of 880° C. and the treatment taking place over two hours.

5. A method according to claim 1, when applied to annealing a steel, wherein said dew-point at the outlet from said furnace of 0° C., and the treatment atmosphere has the following composition:

| | | |
|---|---|---|
| $N_2$ | : | 94.75% |
| $H_2$ | : | 5.0% |
| $C_3H_8$ | : | 0.25% |

the steel being raised to a temperature of 710° C. and the treatment taking place over ten hours.

6. A method in accordance with claim 1, wherein said carrier gas contains both nitrogen and hydrogen.

* * * * *